United States Patent [19]

Saint-Hilaire

[11] Patent Number: 4,703,777

[45] Date of Patent: Nov. 3, 1987

[54] HEDDLESS WITH LATERAL THREADING FOR WEAVING LOOMS

[76] Inventor: Raymond Saint-Hilaire, 903, 12th Avenue, La Pocatière, Canada, G0R 1Z0

[21] Appl. No.: 2,988

[22] Filed: Jan. 13, 1987

[51] Int. Cl.[4] ..... D03C 9/04

[52] U.S. Cl. ..... 139/96

[58] Field of Search ..... 139/29, 30, 31, 93, 139/94, 95, 96

[56] References Cited

U.S. PATENT DOCUMENTS

| | | | |
|---|---|---|---|
| 2,691,389 | 10/1954 | Thorpe | 139/96 |
| 2,964,066 | 12/1960 | Ramseier | 139/95 |
| 4,334,555 | 1/1982 | Hoagland | 139/95 |

FOREIGN PATENT DOCUMENTS

| | | | |
|---|---|---|---|
| 367226 | 8/1906 | France | 139/95 |
| 690582 | 4/1953 | United Kingdom | 139/95 |

*Primary Examiner*—Henry S. Jaudon

[57] ABSTRACT

An improved heddle for conventional harness frames for hand- and industrial looms, having an eyelet-forming body made of single wire construction. The eyelet has a laterally-disposed slot for threading of a warp yarn. The eyelet portion and slot are formed entirely of bent portions of the wire. The eyelet extends angularly rearwardly to allow close grouping of the heddles in the frame. Fasteners are provided at each end of the heddle to mount the same slidably on the harness frame cross-bars.

13 Claims, 6 Drawing Figures

FIG-8
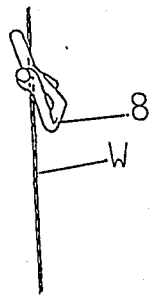
FIG-9
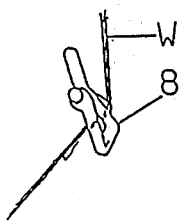
FIG-10
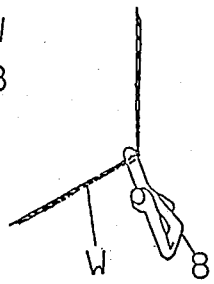
FIG-11
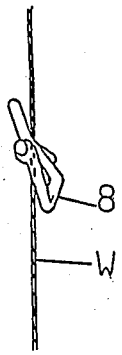
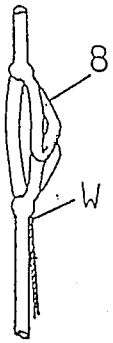
FIG-8A
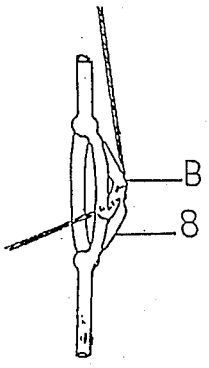
FIG-9A
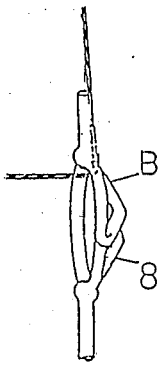
FIG-10A
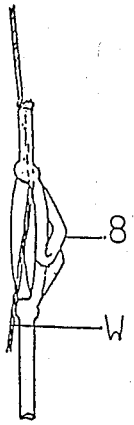
FIG-11A FIG. 12
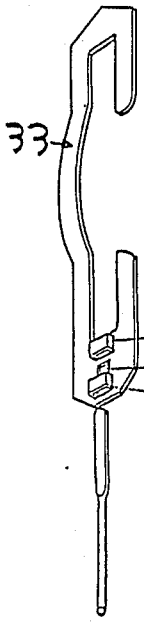
FIG. 13
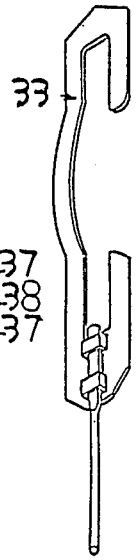
FIG. 14
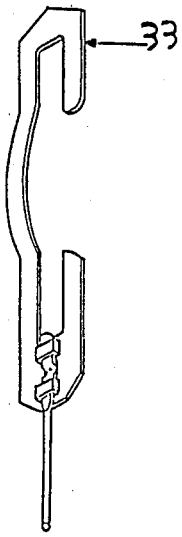
FIG. 15
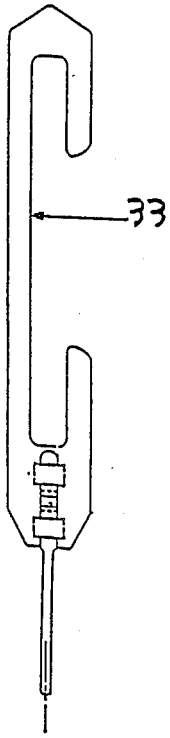
FIG. 16
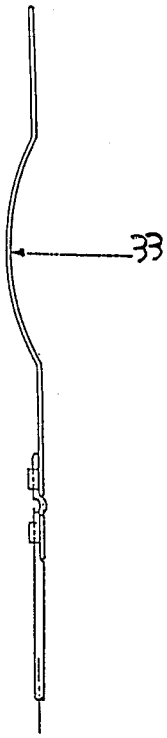
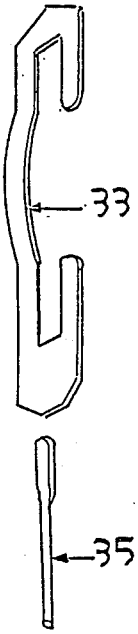
FIG. 17
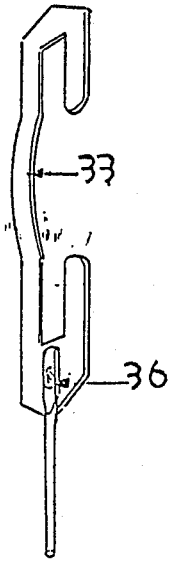
FIG. 18
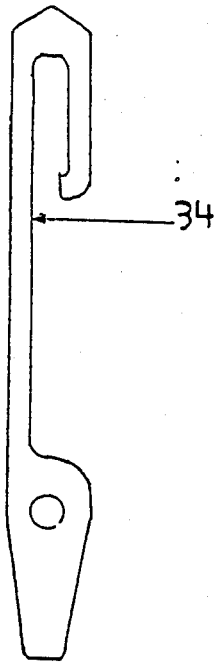
FIG. 19

HEDDLESS WITH LATERAL THREADING FOR WEAVING LOOMS

FIELD OF THE INVENTION

The present invention relates generally to weaving, specifically to improved heddles for looms.

BACKGROUND OF THE INVENTION

The invention disclosed herein is related to Canadian Pat. No. 1,209,442, issued on Aug. 12, 1986 to Raymond Saint-Hilaire. In that patent, there is disclosed a heddle having a threading eye for the warp thread of a loom. The top end of the heddle is entirely free, so that a warp yarn can be inserted and moved down between two adjacent heddles. The eye has a laterally-opening slot which allows easy and rapid threading of the yarn or thread therethrough. There is further disclosed in the patent a harness frame characterized by a lower crossbar, which is straddled by the root portions of the heddles. The crossbar has a channel member to hold the heddles in place, and there is also provided a lock means to hold the heddles and channel member in operative position.

While the above patent is functional, the heddles are not suitable for use with conventional hand- or industrial harness frames. These heddles are made of two wire members secured together, in order to be sufficiently rigid, and the eyelet and lateral opening are formed by bending both wires. Therefore, the number of heddles per inch along the frame is rather limited.

OBJECTS OF THE INVENTION

In view of the above, it is an important object of the present invention to provide an improved heddle designed to suit conventional hand- and industrial harness frames and considerably facilitate threading of the warp yarns.

It is another object of the present invention to provide a heddle having a slanted, lateral threading eyelet relative to a weft plane, thereby allowing a plurality of heddles to be placed above together in the harness frame.

It is still another object of the present invention to provide an improved heddle with means to prevent obstructing or hooking laterally adjacent warp yarns, said heddle also being non-costly to produce.

SUMMARY OF THE INVENTION

The heddle of the invention is sided in a harness frame with top and bottom crossbars. The heddle comprises a single wire provided with fastening means at each end for slidably fastening the wire to the top and bottom crossbars of the harness frame, with the wire normally in an upright position, said single wire forming an intermediate eyelet portion and co-axial straight wire portions above and below said eyelet portion, said eyelet portion integrally formed of bent portions of said single wire, said bent portions defining an upwardly-extending finger and a downwardly-extending finger overlapping each other and defining a yarn-threading slot therebetween, said slot in communication with the interior of said eyelet portion. Preferably, the eyelet extends in a plane angularly disposed relative to the plane of the harness frame, thereby allowing the placing of the heddles closer together.

The fastening means at the two extremities of the heddle can be made by either looping the extremities of the wire or by affixing said extremities to separate fasteners.

BRIEF DESCRIPTION OF THE DRAWINGS

The above will be more clearly understood by having referral to the preferred embodiment of the invention, illustrated by way of the accompanying drawings, in which:

FIGS. 8 to 11 are top plan views of a heddle showing the warp yarn threading sequence;

FIGS. 8*a* to l1*a* are front views corresponding to FIGS. 8 to 11, respectively;

FIGS. 12 to 14 are partial perspective views of a heddle for industrial looms and provided with a separate fastener at each end, said figures showing the sequence of fixing the fastener to the heddle body;

FIGS. 15 and 16 are front and side elevations, respectively, of the assembled parts of FIGS. 12 to 14;

FIGS. 17 and 18 are partial perspective views of another manner of fixing a heddle body to an end fastener; and FIG. 19 is an elevation of another type of fastener which can be fixed to both ends of the heddle body by the means shown better in FIGS. 12 to 16 or FIGS. 17 to 19.

Like reference characters indicate like elements throughout the drawings.

DETAILED DESCRIPTION OF THE PREFERRED EMBODIMENT

Figure 1:
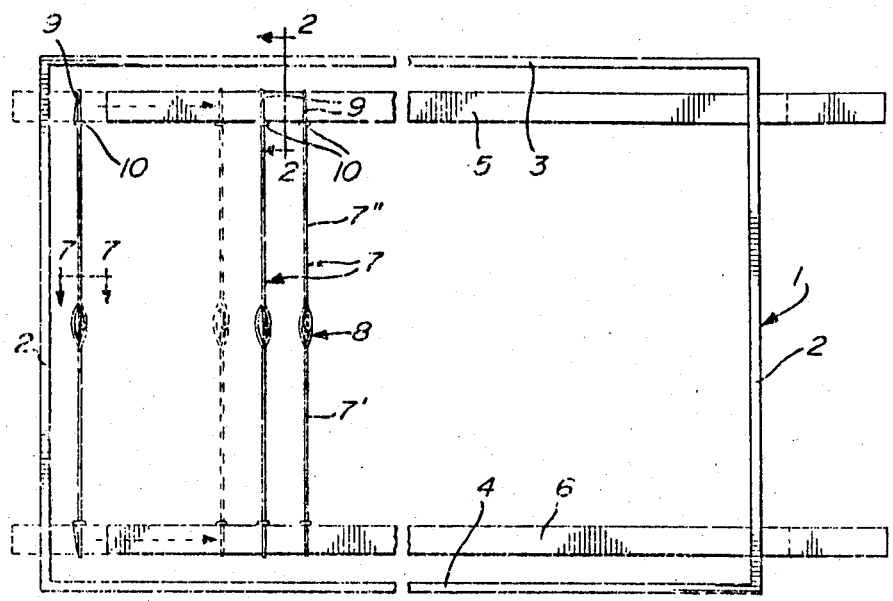
FIG. 1 is a front elevation of a conventional harness frame and of a plurality of heddles mounted therein, said heddles having integral fasteners at each end.

FIG. 1 shows a harness frame 1 for a hand-loom. Frame 1 is comprised of a pair of vertical side planks 2, an upper plank 3 and a lower plank 4. Frame 1 conventionally extends vertically and transversely of the warp yarns and is provided with a mechanism (not shown) to actuate the same in an up-and-down movement. At least one pair of harness frames 1 are provided one behind the other for weaving.

Both vertical side planks 2 are provided with an upper slit and a lower slit (not shown). The upper slits are in registry with each other and slidably receive an upper crossbar 5. The lower slits are also in registry with each other and slidably receive a lower crossbar 6. Both crossbars 5, 6 are longer than frame 1. Each harness frame 1 is adapted to carry a plurality of heddles 7. Each of the latter is of single wire construction, having a straight lower portion 7′ and a straight upper portion 7″, both merging centrally into an eyelet portion designated at 8.

Heddles 7 are mounted slidably on the crossbars 5, 6 by a fastening means, preferably conventionally consisting 1 of an upper and lower rectangularly-turned portion 9, terminated by a releasable hook 10 hooking the straight portion 7′ or 7″.

Figure 2:
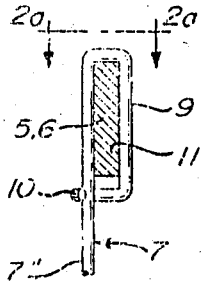
FIG. 2 is a sectional view taken along line 2—2 of FIG. 1.

Portion 9 defines a rectangular aperture 11. The longer dimension of the latter is slightly longer than the width of each crossbar 5, 6 to facilitate the engagement of portion 9, thereon, as seen in FIG. 2. Aperture 11 is also wide enough to suitably receive the thickness of the crossbar.

Figure 2A:
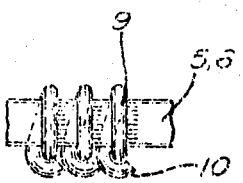
FIG. 2*a* is a plan view taken along line 2—2 of FIG. 2.

FIG. 1 shows crossbars 5, 6 slid to the right, so that the heddles 7 can be installed in frame 1 when their hooks 10 are hooked. Any damaged heddle can be removed and replaced after release of its hook 10. FIG. 2*a* shows that hooks 10 surround the wire through slightly more than 90° to prevent accidental unhooking and yet permit close grouping of the heddles.

Referring now to FIGS. 3 to 7, there is shown eyelet portion 8. The latter is formed integrally with the straight coaxial portions 7′, 7″ of the wire by bent portions of the same. Thus, starting from the upper end of lower portion 7′, eyelet portion 8 includes a frontward bend llA, a flattened, disk-like wire portion 12, followed by an outwardly, laterally and rearwardly-inclined straight wire portion 13, a bend 14, a straight 15, which is vertical in side view but aligned with portion 13 in front view, a bent-back upper end 16 followed by a downwardly-diverging straight wire portion 17, a bend 18, a straight portion 19, downwardly converging towards wire portion 7′ a U-bend 20 nearly in contact with disk-like portion 12 and behind the same.

Portions and bends 13 to 20 form an upwardly-extending finger A on the right side of the eyelet portion 8 looking from front to back of the loom.

U-bend 20 is followed by wire portion 21, which is straight in front view and rearwardly arcuate in side view. Wire portion 21 forms the apertureless left side of eyelet portion 8. It is followed by an inverted U-bend 22, which is aligned with wire portions 7′, 7″. Inverted U-bend 22 is followed by straight portion 23, bend 24, straight portion 25, U-bend 26, straight portion 27, bend 28, straight portion 29, and flattened disk-like portion 30 which is integral with and followed by a bend 31 at the lower end of upper wire portion 7″.

Portions and bends 22 to 29 form a downwardly-extending finger B on the right side of the eyelet portion 8, which overlaps and registers with finger A. The outer end of finger B is practically in contact with finger A, but can be resiliently spread apart to form a yarn threading slot 32, so that a warp yarn W inserted between two adjacent heddles, can be easily threaded into the eyelet portion 8 of the left-hand heddle.

The yarn W is inserted between two heddles from back to front of the loom or the right side of the heddle to be threaded and below its eyelet (FIGS. 8 and 8A). Then the yarn W is applied against the front of the heddle below its upper finger B by pulling the yarn towards the left and then upwardly to insert the yarn slot 32 (FIGS. 9, 9A). The upward movement is continued until full insertion of the yarn into the eyelet (FIGS. 10, 10A). The yarn is thereafter pulled forwardly and attached to the breast beam of the loom. The yarn-threading operation is continuous; requires less than a second; and no hook is required.

Up-and-down movement of frame causes upward and downward flexing of yarn which abuts lower bend 20 and upper bend 22, respectively.

Disk-like portions 12 and 30 prevent those warp yarns which extend on either side of the heddle and which are actuated by other harness frames of the loom from being hooked or caught in the free space between bend 20 and disk-like portion 12 on the one hand and between bend 22 and disk-like portion 30 on the other hand. This is due to the fact that disk-like portions 12 and 30 laterally protrude from the wire at these intersections.

The wire for the heddle may have a diameter of between 15 and 25 mils and is shaped as shown while still malleable; lt is thereafter hardened. The wire can also be made of hard stainless steel, thus requiring no other treatment.

Figure 7:
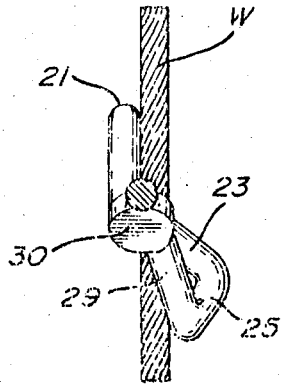
FIG. 7 is a plan section taken along line 7—7 of FIG. 1 and showing the eyelet portion in oriented operative position.
Figure 6:
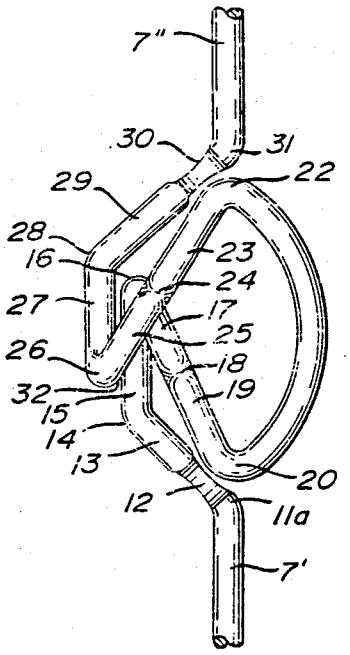
FIGS. 4, 5, and 6 are left side, rear and right side elevations, respectively, of the eyelet portion.
Figure 5:
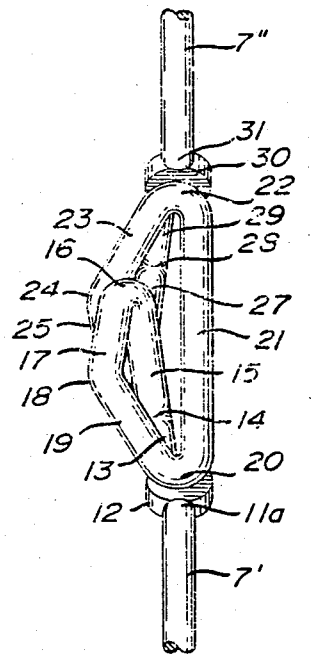
Figure 4:
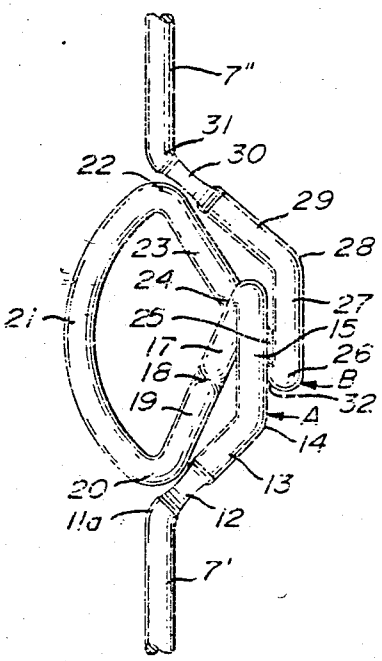
Figure 3:
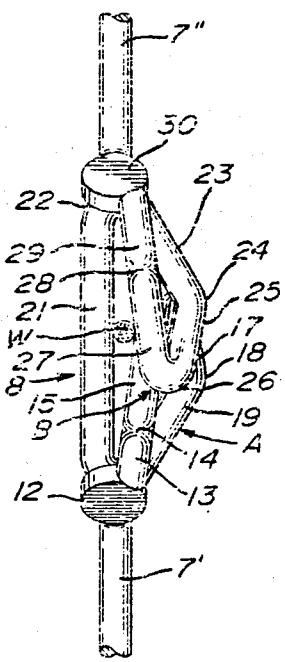
FIG. 3 is a front view of the eyelet portion of a heddle, also showing a cross-sectional yarn on thread engaged in the eyelet.

It will be clear from FIG. 7 that eyelet portion 8 is narrow in the weft direction owing to the fact that its general plane is considerably inclined relative to the plane of retainer loops 9 and, therefore, with respect to the plane of the harness frame 1. Therefore, a plurality of heddles can be mounted very close together per unit length of the frame 1.

FIG. 7 also shows that the same heddle can receive yarns of various diameters. For instance, a yarn of 0.020 inch, as shown, remains straight while sliding on arcuate portion 21 at the back and portions 15 or 27 at the front. A yarn of 0.042 inch in diameter inserted through the same eyelet portion will only make a slight kink while sliding along the same eyelet portions.

FIGS. 12 to 19 show that the single wire of the previous figures can be modified at its ends and attached to standard fasteners used in industrial looms and which are generally either a C-shaped fastener 33 or a J-shaped fastener 34. Fasteners 33, 34 are designed for removable and slidable attachment to the upper and lower standard crossbars of such looms. Suffice to say that such crossbars are made of extruded metal with an inner rail shaped to be inserted within the open space of one or the other type of fasteners. In accordance with the invention, the round wire forming the heddle body is cut to its proper length, then flattened at the ends of its portions 7′, 7″, as shown at 35.

The flattened end portions 35 of the wire can be fixed by spot welding 36 (FIG. 18) to fasteners 33 or 34, which are made of appropriate flat stock.

Another securing means is shown in FIGS. 12 to 16, wherein the inner end of the fastener 33 or 34 is struck out to form two spaced sleeves 37 and an intermediate hole 38. Flattened end portion 35 is inserted within sleeve 37 (FIG. 13); then it is pressed to form a curved kink 39 which enters hole 38 and abuts the edge thereof (FIGS. 14 to 16). A firm attachment is obtained. This latter attachment is best suited for a stainless steel wire.

What I claim is:

1. A heddle for weaving looms having a harness frame with top and bottom crossbars, comprising: a single wire provided with fastening means at each end for suitably fastening the wire to the top and bottom crossbars of the harness frame, with the wire normally in an upright position, said single wire forming an intermediate eyelet portion and co-axial straight wire portions above and below said eyelet portion, said eyelet portion integrally formed of bent portions of said single wire, said bent portions defining an upwardly-extending finger and a downwardly-extending finger overlapping each other, each finger being formed by a U-shaped bent-back portion of said wire so as to define a yarn-threading slot therebetween, said slot in communication with the interior of said eyelet portion.

2. A heddle as defined in claim 1, wherein said fastening means comprises loop-like elements at each end of the heddle for slidably receiving the crossbars of said harness frame.

3. A heddle as defined in claim 2, wherein said loop-like elements are formed at their outer ends with a hook releasably engaging the heddle wire for opening the loop and thus release the heddle from the harness frame crossbar.

4. A heddle as defined in claim 2 or 3, wherein said eyelet portion lies in a plane which is inclined with respect to said loop-like elements, so as to be inclined relative to the warp yarn direction to maximize the number of heddles capable of being disposed side by side per unit length of the harness frame.

5. A heddle as defined in claim 1, wherein the outer portion of each finger lies in a plane substantially parallel to the straight wire portions of the heddle.

6. A heddle as defined in claim 5, wherein the upper finger is downwardly directed and disposed outwardly of the upwardly-directed lower finger.

7. A heddle as defined in claim 6, wherein at least the outer end of the upper finger is in contact with the lower finger.

8. A heddle as defined in claim 7, wherein each finger has two legs, the first leg of each finger being integrally connected to the upper and lower straight wire portions, respectively, while the second legs of both fingers have junctions with a curved wire portion which defines the side of the eyelet laterally opposite to said fingers.

9. A heddle as defined in claim 8, wherein the junctions of the second legs of the respective fingers with the curved wire portion are in substantial alignment with said straight wire portions and practically in contact with the junctions of the first legs of said fingers with the respective straight wire portions.

10. A heddle as defined in claim 9, wherein said last-named junctions are each formed by a flattened wire portion laterally protruding from said junctions to prevent a warp yarn in slidable contact with the heddle on either side thereof from being caught by said heddle.

11. A heddle as defined in claim 1, wherein said fastening means are separate fasteners made of flat stock, said wire being a round wire with flattened end portions, and further including securing means to secure said flattened end portions to said fasteners.

12. A heddle as defined in claim 11, wherein said securing means is a welded joint.

13. A heddle as defined in claim 11, wherein said securing means includes two spaced sleeves and an intermediate hole struck out in said fasteners, said flattened end portion inserted into said sleeves and formed with a kink engaging and pressed into said hole.

* * * * *